US006410886B1

(12) United States Patent
Julien

(10) Patent No.: US 6,410,886 B1
(45) Date of Patent: Jun. 25, 2002

(54) NITINOL HEATER ELEMENTS

(75) Inventor: Gerald J. Julien, Edgewood, WA (US)

(73) Assignee: Nitinol Technologies, Inc., Edgewood, WA (US)

( * ) Notice: Subject to any disclaimer, the term of this patent is extended or adjusted under 35 U.S.C. 154(b) by 0 days.

(21) Appl. No.: 09/113,575

(22) Filed: Jul. 10, 1998

Related U.S. Application Data

(60) Provisional application No. 60/052,206, filed on Jul. 10, 1997.

(51) Int. Cl.[7] ..... H05B 3/00

(52) U.S. Cl. ..... 219/213; 219/542; 219/553; 219/548; 338/306; 148/245; 148/281; 29/611

(58) Field of Search ..... 219/553, 542, 219/504, 505, 521, 522, 538, 213, 200, 201, 543, 544, 546, 548; 60/528; 338/306–309; 148/240, 245, 269, 281

(56) References Cited

U.S. PATENT DOCUMENTS

| | | | | | |
|---|---|---|---|---|---|
| 2,600,485 | A | * | 6/1952 | Cox | 219/541 |
| 3,626,149 | A | * | 12/1971 | Carney et al. | 219/213 |
| 3,703,693 | A | * | 11/1972 | Levinn | 60/527 |
| 4,002,954 | A | * | 1/1977 | Orlando | 318/117 |
| 4,427,000 | A | * | 1/1984 | Ueda | 600/107 |
| 4,556,050 | A | * | 12/1985 | Hodgson et al. | 600/30 |
| 4,684,913 | A | * | 8/1987 | Yaeger | 60/527 |
| 4,715,637 | A | * | 12/1987 | Hosoda et al. | 294/86.4 |
| 4,864,824 | A | * | 9/1989 | Gabriel et al. | 60/527 |
| 4,884,557 | A | * | 12/1989 | Takehana et al. | 600/145 |
| 5,133,721 | A | * | 7/1992 | Angulo | 606/106 |
| 5,254,837 | A | * | 10/1993 | Grimaldi et al. | 403/404 |
| 5,335,498 | A | * | 8/1994 | Komatsu et al. | 60/528 |
| 5,686,003 | A | * | 11/1997 | Ingram et al. | 219/201 |
| 5,800,500 | A | * | 9/1998 | Spelman et al. | 607/137 |
| 5,800,634 | A | * | 9/1998 | McWilliams et al. | 148/285 |
| 5,827,268 | A | * | 10/1998 | Laufer | 606/28 |
| 6,072,154 | A | * | 6/2000 | Maynard | 219/548 |

FOREIGN PATENT DOCUMENTS

| | | | |
|---|---|---|---|
| GB | 2065882 | * | 7/1981 |
| JP | 6-147380 | * | 5/1994 |
| WO | 9741274 | * | 11/1997 |

OTHER PUBLICATIONS

Chapter 4 (pp. 23–28) from "55–Nitinol—the Alloy with a Memory: Its Physical Metallurgy, Properties and Applications" by C.M. Jackson, H.J. Administration, 1972.

* cited by examiner

*Primary Examiner*—John A. Jeffery
(74) *Attorney, Agent, or Firm*—J. Michael Neary

(57) ABSTRACT

An electrical resistive heating system having a Nitinol heater element in the form of wire, rod strip or tube, is flexible, ductile, tough aid chemically non-reactive. The element has connectors at each end for leads from a controller that controls the flow of current through the heater element from a source of electrical power. The Nitinol heater element is treated to have an electrically insulating surface that is also hard and chemically non-reactive, so the heater element can be put in intimate contact with the materials or substrate to be heated without shorting or electrical shock to people or equipment. The controller uses temperature data feedback from a separate temperature sensor such as a thermocouple, or uses the resistance of heater element itself as a temperature sensor, since the resistance of the Nitinol changes with temperature in a predictable way.

17 Claims, 7 Drawing Sheets

NITINOL HEATER ELEMENTS

This is related to Provisional Patent Application No. 60/052,206 for "Nitinol Heater Elements" filed by Gerald J. Julien on Jul. 10, 1997.

BACKGROUND OF THE INVENTION

This invention pertains to electrical heater elements, and more particularly to metallic electrical heater elements with high tolerance to severe environmental influences and physical abuse, and having integral ceramic surface material for electrical insulation and chemical compatibility with many liquids and other materials in which the heater elements would be immersed or embedded in operation.

Electrical heater elements have existed for many years and the technology is well understood. The most well known material for electrical heater elements is Nichrome, a composition of 61% nickel, 24% iron, and 15% chromium. Nichrome performs adequately as an electrical heater element in numerous applications and has a low temperature coefficient of electrical resistance, but is chemically reactive, is sensitive to thermal shock, and must be electrically insulated from contact with conductive materials to prevent shorting the element or exposing people or equipment to electrical shock.

Most conventional uses of electrical heating elements use one of two basic approaches to insulating the element from contact with conductive elements in the environment. The first is to support the electrical heater element in high temperature insulators in an enclosure designed to prevent contact with the heater element by anything but the insulator and the surrounding air. The second is to encase the heater element in an electrically insulating high temperature material such as ceramic granules inside a metallic sheath. Elements of this second type are safe and relatively durable, but are expensive and burn out after a relatively short life. Moreover, they are rigid so they cannot be easily bent to conform to the item they are intended to heat.

Flexible heat tapes have been developed that can be wrapped around articles to be heated, such as water pipes to prevent them from freezing. Heat tapes have satisfied a need in many applications and are in wide use. However, heat tapes are generally low temperature devices because of the supporting fabric material to which they are connected, and the heater elements in the heater tape must be electrically insulated just like other heaters. Such electrical insulation also serves as heat insulation, so heat tapes are generally inefficient because of low heat transfer efficiency to the articles to be heated.

Thus, the art of electrical heating has long needed a simple, inexpensive heater element that is chemically non-reactive, has durable integral electrical insulation, and is insensitive to thermal shock. Ideally, such a new electric heating element would also function as a temperature indicator so that its power supply could be programmed to apply power to maintain a desired temperature or otherwise only when needed. Finally, such an ideal heater element would be flexible, and capable of being manufactured a many different sizes and forms, such as wires, flat strips and wide sheets.

SUMMARY OF THE INVENTION

Accordingly, it is an object of this invention to provide an electrical heater element that is durable and insensitive to thermal shock. Another object of this invention is to provide a method of heating using an electrical heater element in direct contact with the substrate or material to be heated.

These an other objects of the invention are attained in an electrical resistive heating system having a Nitinol heater element in the form of wire, rod strip or tube, and having connectors at each end for leads from a controller that controls the flow of current through the heater element from a source of electrical power. The Nitinol heater element is treated to have an electrically insulating surface that is also hard and chemically non-reactive, so the heater element can be put in intimate contact with the materials or substrate to be heated without shorting or electrical shock to people or equipment.

DESCRIPTION OF THE DRAWINGS

The invention and its many attendant objects and advantages will become better understood upon reading the following detailed description of the preferred embodiments in conjunction with the following drawings, wherein.

DESCRIPTION OF THE PREFERRED EMBODIMENTS

Figure 1:
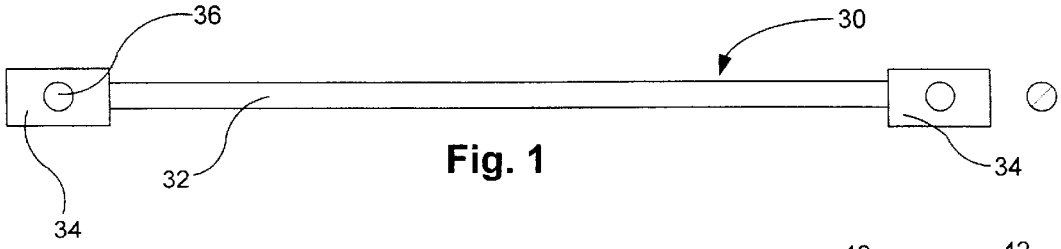
FIG. 1 is a plan view of a Nitinol heater element in accordance with this invention in the form of a round rod or wire having connectors at each end.

Turning now to the drawings, wherein like reference numerals designate identical or corresponding parts, and more particularly to FIG. 1 thereof, a Nitinol heater element 30 in accordance with this invention is shown having a round rod or wire 32 and two end connectors 34 by which the heater element is connected into an electrical circuit by which electrical power is supplied to the heater element 30. The end connectors 34 are preferably made of copper and are welded or swaged onto the two ends of the wire 32. The heater element is made of a nickel-titanium composition known as Nitinol. Type 55 Nitinol, made of 55% by weight nickel and 45% titanium, and Type 60 Nitinol, made of 60% by weight nickel and 40% titanium as well as various ternary and quaternary compositions of Nitinol can be used to make these heater elements for the particular properties they add.

The element 30 can be made by heating a rod to a high temperature, above about 950° C., and pulling the two ends 34 clamped in end clamps. The rod elongates uniformly without necking at that high temperature and the result is an integral rod or wire 32 of desired diameter with integral end connectors 34. Alternatively, the wire 32 can be made of Nitinol wire pre-drawn to the desired gauge. Holes 36 can be drilled in the end connectors 34 for connecting the heater element into the electrical circuit. Alternatively, the end connectors 34 can be threaded using the process disclosed in my co-pending application 08/349,872 filed on Dec. 6, 1994 and entitled "Threaded Load Transferring Attachment".

In some heater element applications, it may be desirable to avoid heating the connectors 34 to avoid heat effects at the end connections where the heater element 30 is connected to the electrical leads from the power source. To this effect, the ends of the Nitinol wire 32 can be scarfed and welded or sleeve crimped to a length of copper wire of sufficient length to thermally isolate the connectors from the heated length of Nitinol wire. Alternatively, the ends of the Nitinol wire can be coated with a thick layer of copper which will conduct the electrical current to the uncoated portion of the Nitinol wire without causing significant electrical or conductive heating at the end portions.

The rod or wire 32 can be processed to have can integral surface insulation that is hard, chemically inert to most influences, and electrically non-conductive. Integral is intended to mean the kind of surface that is created when the parent material combines chemically with other materials such as air to produce an indivisible part of the parent material at the surface that is chemically different but physically united to the underlying substrate as intimately as the original parent material at the surface was. The process for producing this surface insulation is disclosed in detail in my co-pending PCT application PCT/US97/02324 filed on Feb. 14, 1997, the disclosure of which is incorporated herein by reference. That process was specifically related to Type 60 Nitinol, but applies also to Type 55 Nitinol, although the colors that can be attained by the process for Type 55 Nitinol may be limited to gray or black. In summary, the process is to heat the Nitinol heater element to a temperature of about 500° C.–800° C. in an oxygen rich atmosphere such as air, and allow it to air cool. The integral insulation surface portion 38 allows the heater element 30 to be in intimate physical, heat conductive transferring relationship with the material which is to be heated without risk of electrically shorting the heater element 30 or exposing the people around the heated materials or the equipment to danger of electrical shock.

Figure 2:
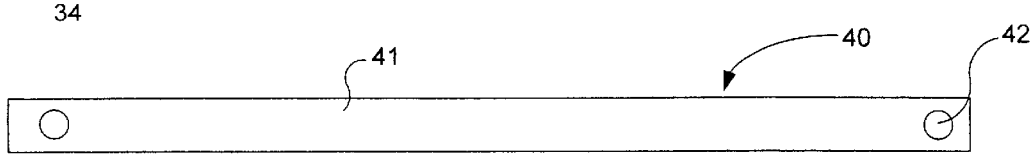
FIGS. 2 and 3 are plan and elevation views, respectively, of a flat strip or ribbon heater according to this invention.
Figure 3:
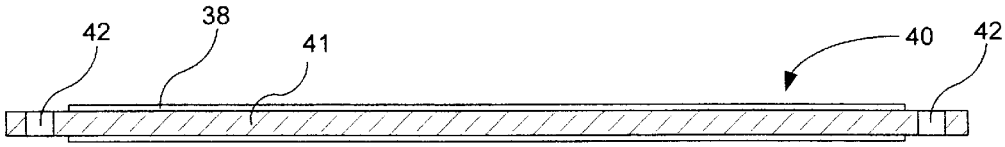

A flat heater element 40, shown in FIGS. 2 and 3, is a ribbon 41 cut by electron beam, abrasive water jet, or preferably by laser from a flat sheet of the desired Type 55 or Type 60 Nitinol, and the end holes 42 can be cut by laser or drilled. An insulating surface 38 can be produced in the same manner as described above. If the entire element 40 is treated to have the surface insulation, it would be desirable to grind the surface material off the ends to facilitate electrical connection with the electrical connector by which the element is connected electrically into the energizing circuit, described below.

Figure 4:
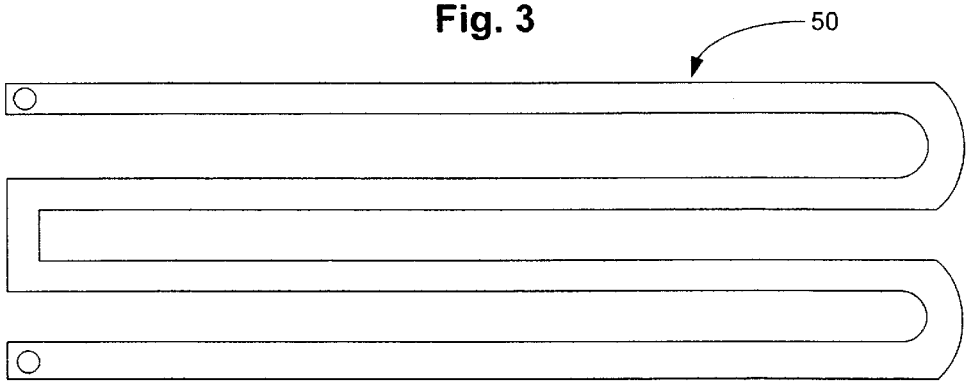
FIG. 4 is a plan view of a serpentine ribbon heater element according to this invention.

A serpentine heater element 50, shown in FIG. 4, illustrates the various shapes that can be made from the Nitinol sheet material. Likewise, the heat distribution can be designed as desired by the dimensions and heat requirements of the element. The sheet material from which the serpentine element is cut can be rolled by known rolling techniques to any suitable thin gauge desired, e.g. 030", and laser cut from the sheet of rolled Nitinol material. Careful adjustment of the laser power and laser carriage travel speed can produce a cut surface that is free of slag or splatter and requires no touch-up trimming. The processing to produce the surface insulation is preferably performed after the element 40 is cut from the sheet.

Figure 5:
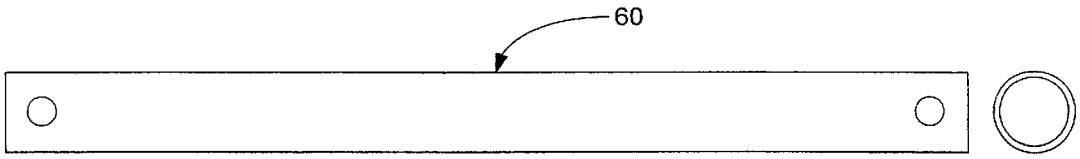
FIGS. 5–7 are elevation and perspective views of tubular Nitinol heater elements in accordance with this invention.
Figure 3B:
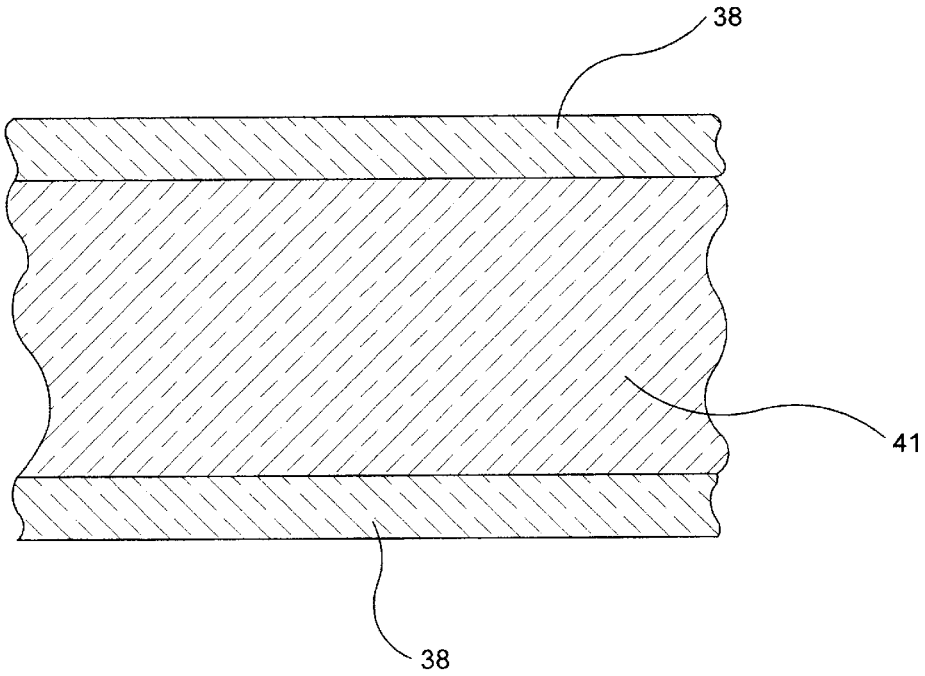
Figure 5B:
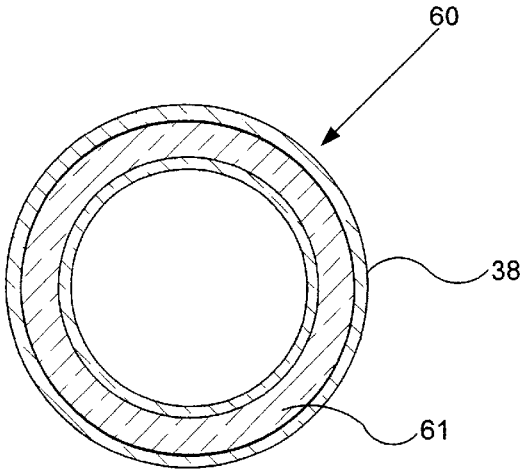
Figure 5B:
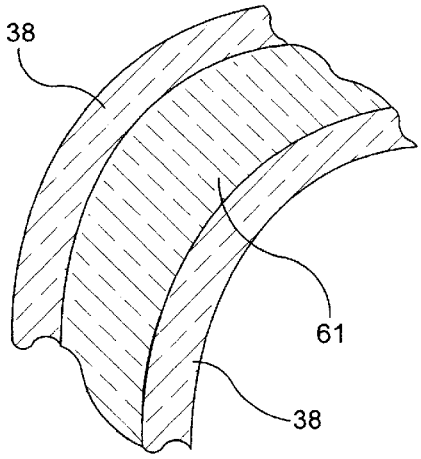
Figure 6:
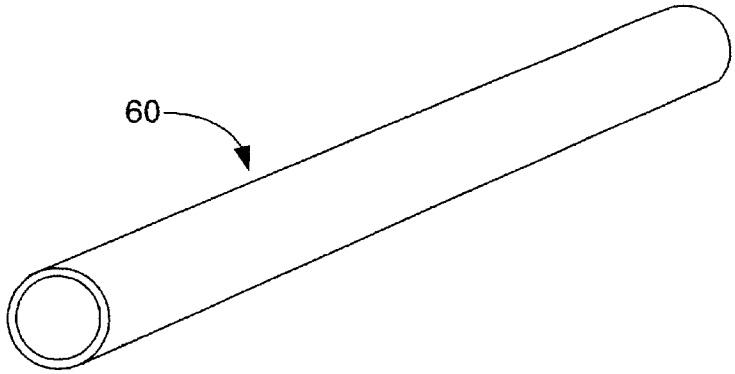
Figure 7:
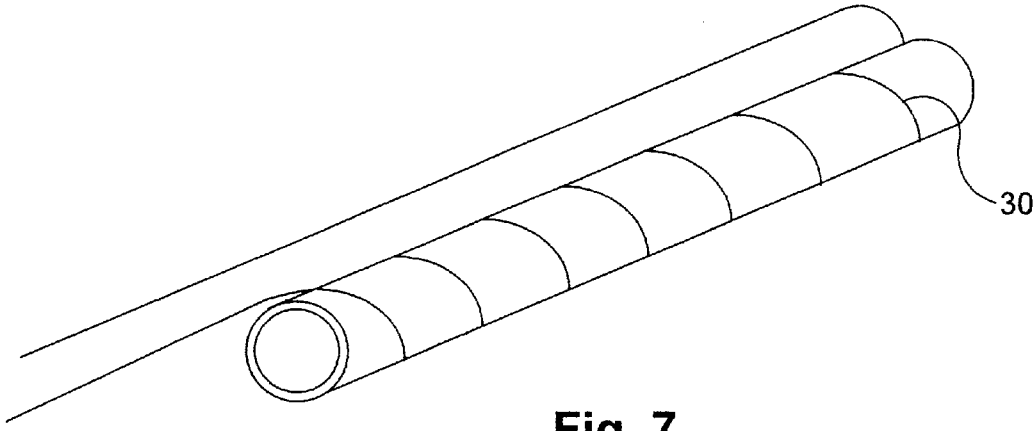

A tubular heater element 60 is shown in FIG. 5 for heating fluids, such as water or gas, by passing them through the tube as it is electrically heated. The tube can be made by rolling and laser welding the Nitinol along a longitudinal seam, or it can be pulled at high temperature, as described above, from a shorter thick walled tube made from a drilled cylinder. A hot water heater made from such a tube is shown in FIG. 6. Another hot water heater could be made from a conventional tube having a Nitinol heater element 30 or 40 such as those shown in FIGS. 1–3, inside the tube or wrapped around its outside surface, as shown in FIG. 7.

Figure 8:
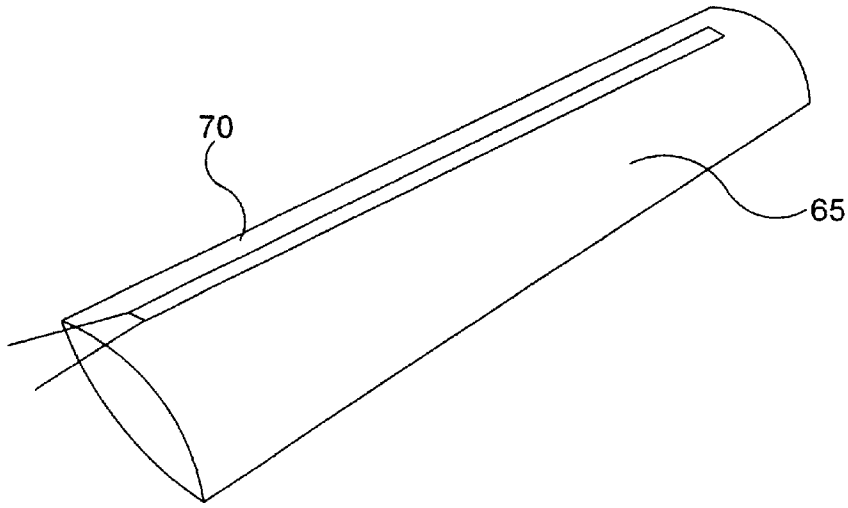
FIG. 8 is a schematic perspective view of an airplane wing having a leading edge de-icer using a Nitinol heater element.

An aircraft wing de-icing system is shown in FIG. 8. The Nitinol heater elements 70, which could be like those shown in FIGS. 2–3 or like the element 50 shown in FIG. 4 are bonded to the leading edge of the wing 65, or the entire surface of the leading edge could be thin film Nitinol with electrical contacts located along the edges to provide electrical resistance heating to the leading edge. The non-stick surface of the Nitinol sheet material would facilitate shedding of ice coatings with little power consumption, and the corrosion resistance and toughness of the Nitinol would provide a strikingly attractive and durable leading edge.

Another application process for the leading edge wing de-icing system shown in FIG. 8 is to apply an insulating layer of a ceramic, such as alumina or boron nitride by plasma spraying or the like to the leading edge structure of the wing. Nitinol can then be reduced to a stream of fine particles such as vapor or droplets and applied to the substrate and over the connectors in a low pressure chamber, as in plasma spraying or the like. Power can be applied to the Nitinol heater element through the connectors spraying may be done in accordance with a process taught in Provisional Application No. 60/064,734 filed on Nov. 6, 1997 and entitled "Plasma Spraying of Nitinol". The Nitinol can be applied in an interlocking grid pattern or parallel serpentines that would be fault tolerant, or could be applied as the continuous layer. There would be no need to apply an insulating layer over the Nitinol because the insulating surface would develop when it was heated in use. The underlying layer of ceramic insulation applied to the leading edge structure would prevent the heater element from being shorted by the leading edge structure, which is typically aluminum.

Figure 9:
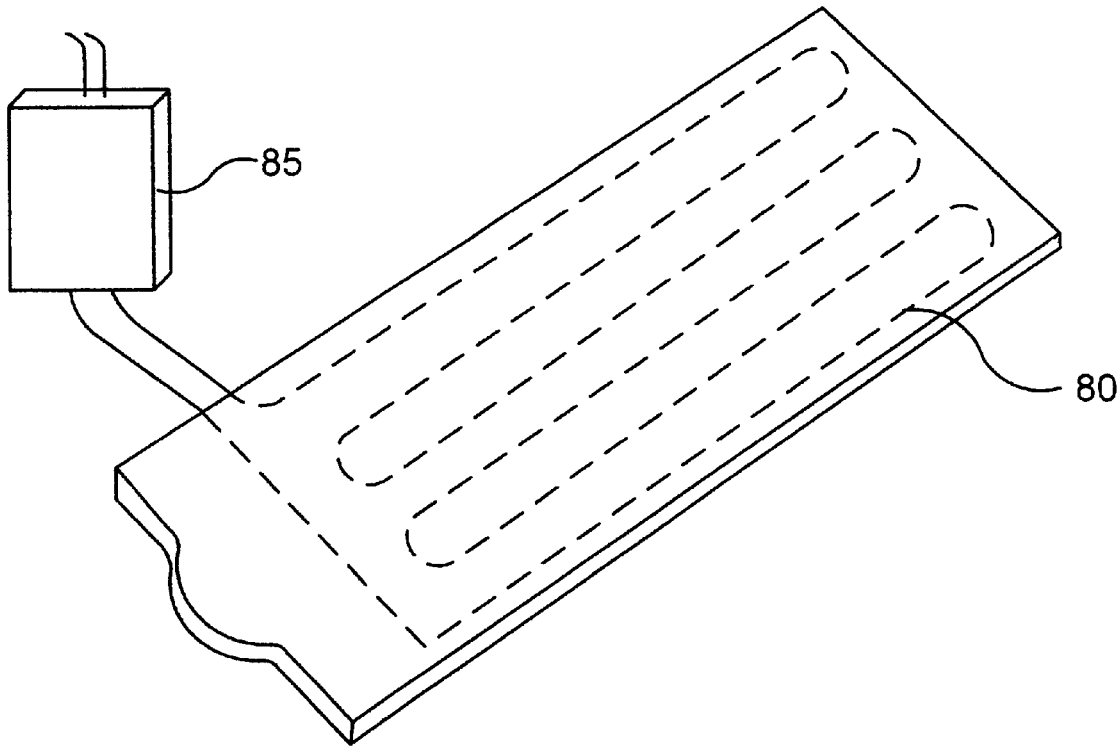
FIG. 9 is a schematic perspective view of a surface heated by embedded Nitinol heater elements in accordance with this invention.

Nitinol is flexible, ductile, tough and non-reactive. It is insensitive to thermal shock and tolerates mechanical fatigue loading without cracking. These properties make Nitinol heater elements the first practical electrical heater elements that are suitable for embedding in concrete for heating floors, walkways, stairs and roads because of their ability to survive cracks in the concrete which normally would break a heater element made of conventional materials known and conventionally used in the art as heater elements. The Nitinol can elongate greater than 6–8% under tensile forces without breaking, so it will not break when concrete in a roadway, sidewalk or floor cracks, as it inevitably does over time. As shown in FIG. 9 the heater element 80 has a serpentine pattern but many other patterns are envisioned such as a ladder pattern having Nitinol "rungs" extending in parallel between power leads lying alongside the edges of the roadway or walkway. The power produced by the heater elements 80 is controlled by a controller 85 which uses temperature data feedback from a separate temperature sensor such as a thermocouple, or uses the resistance of heater element itself as a temperature sensor, since the resistance of the Nitinol changes with temperature in a predictable way. The controller is discussed below in conjunction with FIGS. 12 and 13.

Figure 10:
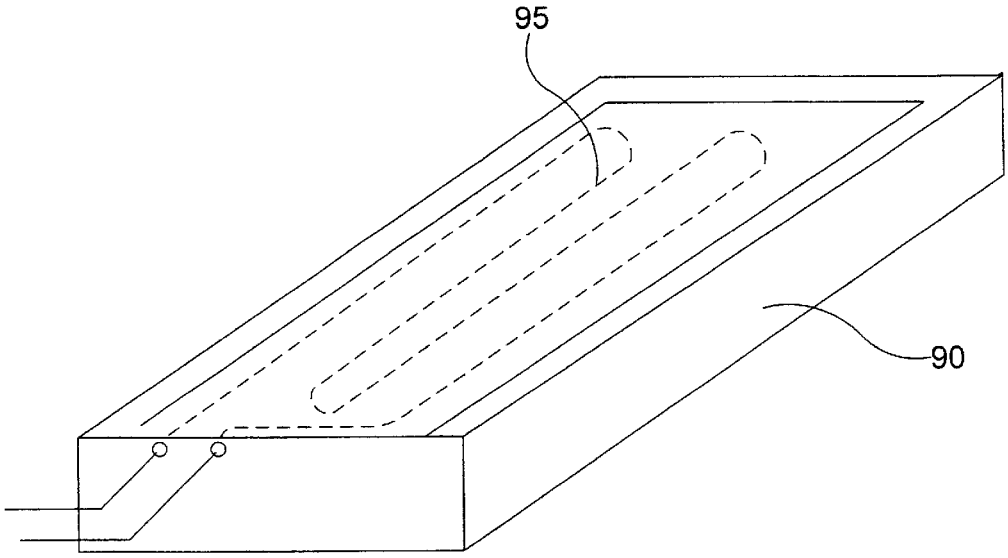
FIG. 10 is a perspective view of a container for holding a material to be maintained at a desired temperature, and Nitinol heater elements embedded in the material for adding enough heat to maintain the desired temperature.

A hydroponic or soil planting bed 90 is shown in FIG. 10, having a Nitinol heater system for maintaining the temperature in the bed at the optimal growing temperature. The heater system includes a serpentine Nitinol heater element 95 embedded in the growth medium of the bed 90 and in direct contact therewith for providing heat efficiently to the growth medium in the bed 90 while the insulating surface on the heater element 95 eliminates any risk of shorting through the growth medium or electrical shock to the workers.

Figure 11:
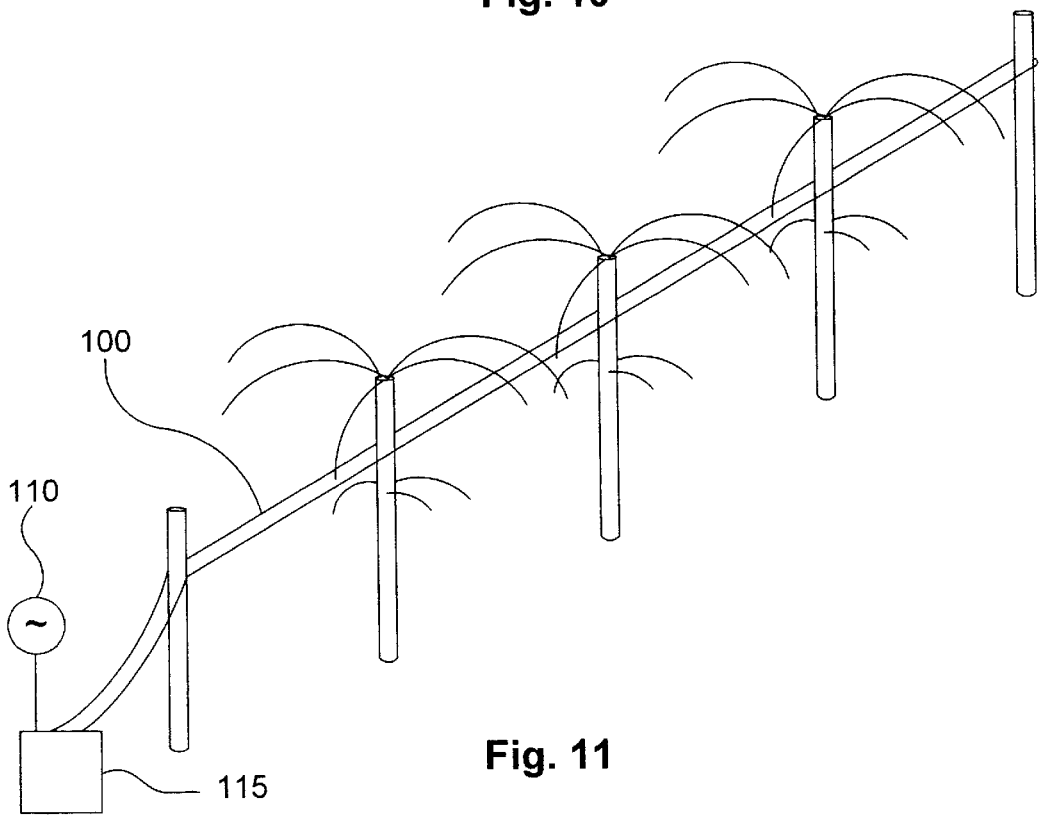
FIG. 11 is a schematic perspective view of a Nitinol electrical heater element system in an orchard for protection of the trees against freezing.

The Nitinol heater element can be adapted for various types of environmental heating, including the orchard heater shown in FIG. 11. The rugged nature of the Nitinol and the electrical insulation on its surface allows a Nitinol heater element 100 to be strung through the Orchard by way of small heat insulators in the tree branches with little danger of breaking or electrical shock to workers. Power is applied to the Nitinol heater element 100 from the electric grid 110 through a controller 115, as described below.

Figure 12:
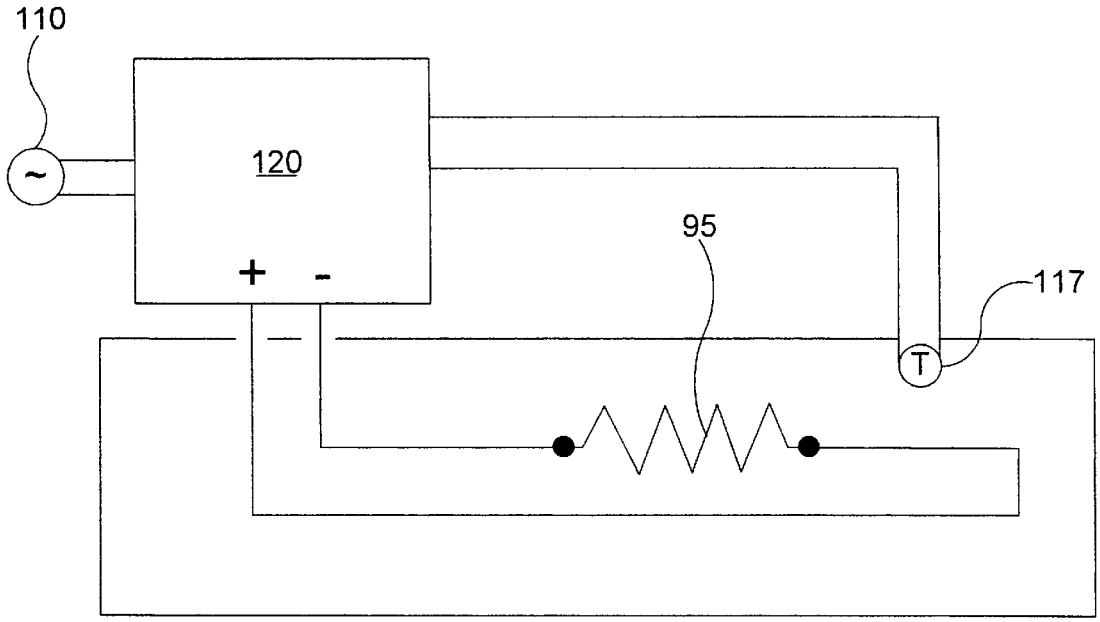
FIGS. 12 and 13 are two electrical circuit schematics of control systems for Nitinol heater elements in accordance with this invention.
Figure 13:
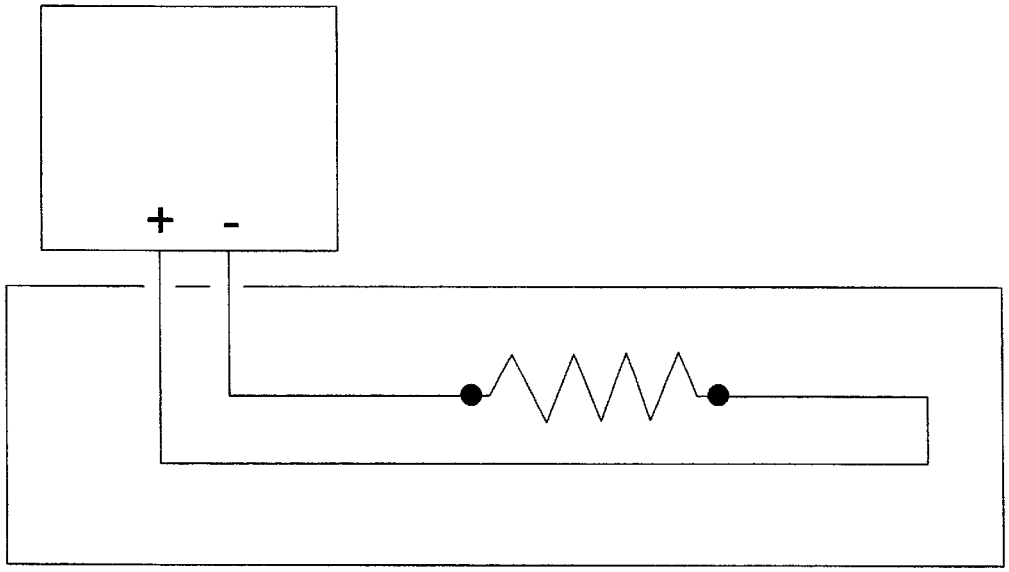

An electrical controller 120, shown in FIG. 12, is a current limiting controller for controlling the current in the Nitinol heater element 95. The controller 120 uses feedback from a temperature sensor 117 in the material being heated. Alternatively, a controller 125, shown in FIG. 13, uses a resistance sensor, known in the art, in the controller for measuring the resistance of the Nitinol heater element 95. The resistance of Nitinol is a function of temperature and the temperature can be determined by knowing the resistance. Thus, a desired temperature can be maintained by measuring the resistance of the element when the power is turned off because the intimate contact of the heater element 95 with the material being heated will quickly equalize the temperature of the material and the heater element 95 so it functions as a temperature probe for feedback to the controller.

Figure 14:
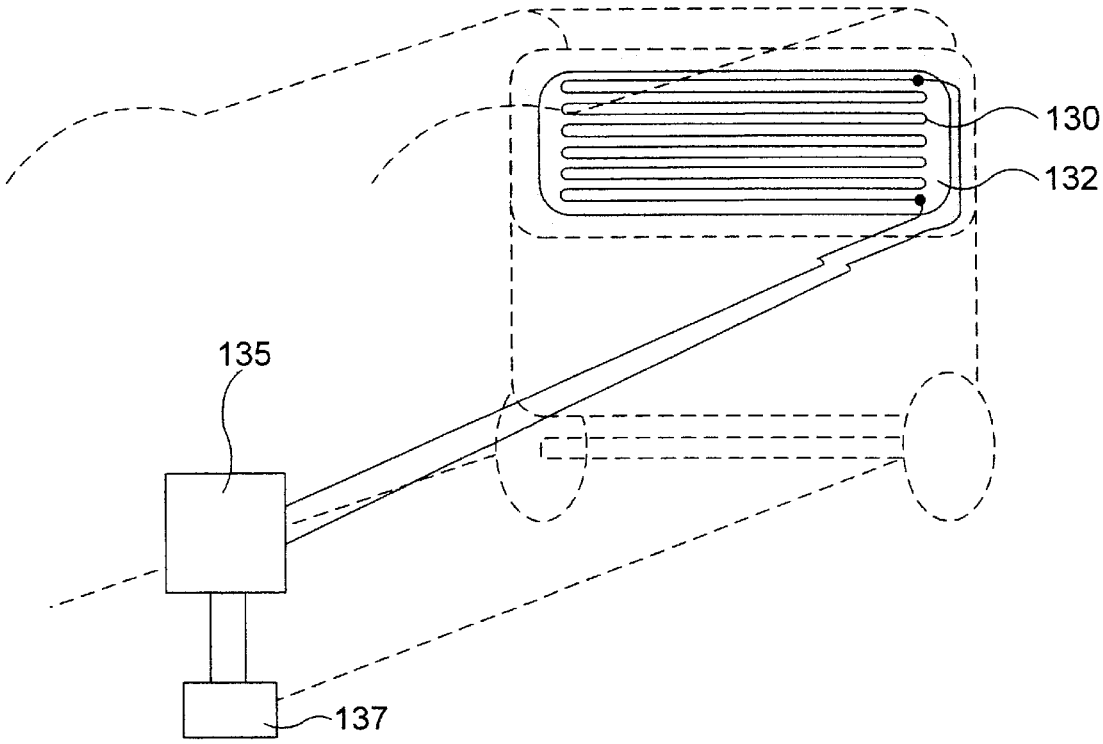
FIG. 14 is a schematic perspective view of an automobile rear window defroster using Nitinol heater elements in accordance with this invention.

An automobile rear window defroster system is shown in FIG. 14 includes a Nitinol heater element 130 bonded to or plasma sprayed through a stencil onto the rear window 132 in a serpentine pattern. Other patterns could also be used, such as the ladder pattern mentioned above. A controller 135 for controlling current from the automobile battery 137 to the heater element 130 is based on maintaining current of a predetermined magnitude, sufficient to keep the window warm but not hot. The heater control accessible to the driver could have several heat levels for different conditions, such as "Normal", "Extra" and "Extreme" or the like so a greater level of control would be available to the driver in cases of unusual fogging or icing conditions.

Obviously, numerous modifications and variations of the preferred embodiment described above are possible and will become apparent to those skilled in the art in light of this specification. For example, many functions and advantages are described for the preferred embodiment, but in some uses of the invention, not all of these functions and advantages would be needed. Therefore, I contemplate the use of the invention using fewer than the complete set of noted functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly intended that all these embodiments, species, modifications and variations, and the equivalents thereof, are to be considered within the spirit and scope of the invention as defined in the following claims.

Wherein I claim:

1. An electrical resistance heater element for heating a material or substrate in intimate contact with said heater element, comprising:

a Nitinol ribbon having electrical contacts at opposite ends of said element for connection to an electrical circuit producing a flow of current to said Nitinol ribbon for heating of said material or substrate, and having an integral electrically insulating surface for preventing electrical shorting of said element by said substrate or material, and for preventing electrical shocks to people in contact with said element.

2. An electrical resistance heater element as defined in claim 1, wherein said Nitinol ribbon is applied to said material or substrate by particle deposition.

3. An electrical resistance heater element as defined in claim 1, wherein:

said integral electrically insulating surface includes an material formed by reacting said Nitinol in said element with air at elevated temperatures.

4. A method of heating a material, comprising establishing direct contact between an electrical resistance heater element made of Nitinol and said material;

passing a flow of electrical current through said element to raise the temperature thereof by electrical resistance heating and produce a heat flux to said material; and conducting heat from said element to said material;

wherein said Nitinol heater element has an integral electrically insulating surface that allows intimate contact between said heater element and said material while preventing said heater element from being shorted and while protecting said material and people nearby from electrical shocks.

5. A method of heating a material as defined in claim 4, wherein:

said electrical resistance heater element is embedded in concrete.

6. A method of heating a material as defined in claim 4, further comprising:

conducting electrical current via power leads to ends of said Nitinol electrical resistance heater element and from there through a coating of copper over portions of said ends to prevent heating said ends of said element at connections between said power leads and ends of said heater element.

7. An electrical resistance heater system having at least one electrical resistance heater element for heating a material or substrate in intimate contact with said heater element, wherein:

said electrical resistance heater element is made of Nitinol and includes an integral electrical insulating surface and electrical contacts at each of two ends;

electrical leads connected to each of said two ends; and a controller for controlling a current to said leads from a source of electrical power.

8. An electrical resistance heater system as defined in claim 7, further comprising:

temperature feedback from said Nitinol heater element to said controller using a resistance measurement of said Nitinol heater element to determine temperature.

9. An electrical resistance heater system as defined in claim 7, wherein:

said integral electrically insulating surface includes an material formed by reacting said Nitinol in said element with air at elevated temperatures.

10. An electrical resistance heater system as defined in claim 7, wherein:

said controller controls current to said electrical resistance heater element to control heat output from said element by sensing the electrical resistance of said element as a function of temperature.

11. An article comprising:

a substrate to be heated;

an electrical resistance heater element having a surface in heat transferring contact with said substrate for supplying heat to said substrate;

said electrical resistance heater element including a Nitinol element having opposite ends, and electrical contacts at said opposite ends for connection to electrical leads for supplying a electrical current to heat said Nitinol element by electrical resistance heating and transfer a flow of heat to said substrate for heating of said substrate; and an integral electrically insulating material on said surface of said electrical resistance heater element including a material formed by reacting said Nitinol in said element with air at elevated temperatures.

12. An article as defined in claim 11, further comprising:

a current controller for controlling current from a source of electrical power to said electrical resistance heater element to control heat output from said element by sensing the electrical resistance of said element as a function of temperature.

13. An electrical resistance heater element for heating of a substrate in intimate contact with said heater element, comprising:

a Nitinol element having electrical contacts at opposite ends of said element for connection to an electrical power supply for producing a flow of current to said heater element to heat said element to an elevated temperature by electrical resistance and maintain said temperature for a duration to produce a substantial heat flux to said substrate;

an integral electrically insulating material on surfaces of said electrical resistance heater element including a material formed by reacting said Nitinol in said element with air at elevated temperatures.

14. An electrical resistance heater for heating a material or substrate to be heated in intimate contact with said heater, comprising:

heater element means for conducting a flow of electrical current therethrough and raising said heater element to an elevated temperature and maintaining said heater element at said elevated temperature and thereby producing a flow of heat by electrical resistance heating, said heater element means being made of Nitinol;

electrical contacts at each of two ends of said heater element means for connecting power leads to said heater element means by which said flow of electrical current from a source of electrical power may be conducted to said heater element means; and electrical insulation means integral with said heater element means and in intimate contact with said substrate for insulating said heater element electrically from said substrate and for conduction of heat directly from said heater element to said substrate.

15. An electrical resistance heater as defined in claim 14, wherein:

said electrical insulation means includes a material formed by reacting said Nitinol in said element with air at elevated temperatures.

16. An electrical resistance heater as defined in claim 14, further comprising:

a controller for controlling current from said source of electrical power to said leads.

17. An electrical resistance heater as defined in claim 16, wherein:

said controller controls current to said electrical resistance heater element to control heat output from said element by sensing the electrical resistance of said element as a function of temperature.

* * * * *